US009509085B2

(12) United States Patent
Morikawa

(10) Patent No.: US 9,509,085 B2
(45) Date of Patent: Nov. 29, 2016

(54) WIRE WITH CORROSION-RESISTANT TERMINAL

(71) Applicant: Sumitomo Wiring Systems, Ltd., Mie (JP)

(72) Inventor: Satoshi Morikawa, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 14/770,145

(22) PCT Filed: Mar. 12, 2014

(86) PCT No.: PCT/JP2014/056431

§ 371 (c)(1),
(2) Date: Aug. 25, 2015

(87) PCT Pub. No.: WO2014/142150

PCT Pub. Date: Sep. 18, 2014

(65) Prior Publication Data

US 2016/0006167 A1 Jan. 7, 2016

(30) Foreign Application Priority Data

Mar. 15, 2013 (JP) ..... 2013-052970

(51) Int. Cl.

| | |
|---|---|
| ***H01R 11/20*** | (2006.01) |
| ***H01R 13/533*** | (2006.01) |
| ***H01R 4/62*** | (2006.01) |
| ***H01R 4/16*** | (2006.01) |
| ***H01R 4/70*** | (2006.01) |
| *H01R 4/18* | (2006.01) |

(52) U.S. Cl.

CPC ..... *H01R 13/533* (2013.01); *H01R 4/16* (2013.01); *H01R 4/18* (2013.01); *H01R 4/62* (2013.01); *H01R 4/70* (2013.01); *H01R 4/185* (2013.01); *H01R 4/188* (2013.01)

(58) Field of Classification Search

CPC ..... H01R 13/533; H01R 4/62; H01R 4/188; H01R 4/16; H01R 4/18; H01R 4/185; H01R 4/70

USPC ..... 439/524, 741, 877

See application file for complete search history.

(56) References Cited

U.S. PATENT DOCUMENTS

| | | | | |
|---|---|---|---|---|
| 8,622,776 | B2 * | 1/2014 | Morikawa | H01R 4/185 439/883 |
| 2012/0329341 | A1 * | 12/2012 | Morikawa | H01R 4/185 439/866 |

FOREIGN PATENT DOCUMENTS

| | | |
|---|---|---|
| JP | 2003-297447 | 10/2003 |
| JP | 2010-108798 | 5/2010 |
| JP | 2011-192530 | 9/2011 |
| JP | 2012-190635 | 10/2012 |
| JP | 2013-211207 | 10/2013 |

OTHER PUBLICATIONS

International Search Report, (Jul. 2009).

* cited by examiner

*Primary Examiner* — Khiem Nguyen
(74) *Attorney, Agent, or Firm* — Gerald E. Hespos; Michael J. Porco; Matthew T. Hespos

(57) ABSTRACT

A wire with corrosion-resistant terminal (60) includes an aluminum wire (40) and a corrosion-resistant terminal (10) is formed from a base material made of copper alloy. The terminal (10) includes a wire connecting portion (30) connected to an end of the aluminum wire (40). The copper alloy exposed on an end part of the wire connecting portion (30) is covered with an anticorrosive (50). End parts of the base material in the wire connecting portion (30) face inward on an upper surface of the wire connecting portion (30) while winding around the end of the aluminum wire (40). A storage portion (33, 34) is surrounded by the end parts of the base material, and the anticorrosive (50) is stored in the storage portion (33, 34) in a region (R1, R2) narrower than a maximum width region (W1, W2) on the upper surface of the wire connecting portion (30).

5 Claims, 15 Drawing Sheets

WIRE WITH CORROSION-RESISTANT TERMINAL

BACKGROUND

1. Field of the Invention

The present invention relates to a wire with corrosion-resistant terminal.

2. Description of the Related Art

In recent years, aluminum wires have been used for the purpose of weight reduction and the like also in the fields of automotive wiring harnesses and the like. In electrically conductively connecting an aluminum wire to a terminal, electrolytic corrosion in which metals are dissolved in the form of ions in moisture and the corrosion of base metals proceeds by an electrochemical reaction is known to occur if a core of the aluminum wire and the terminal are formed of different types of metals, particularly if moisture is present on a contact part of the both. Here, since the terminal is formed by press-working a copper base material, the electrolytic corrosion of the aluminum wire becomes problematic between copper and aluminum if the aluminum wire is used as a wire as described above.

Accordingly, in a wire with terminal described in Japanese Unexamined Patent Publication No. 2003-297447, electrolytic corrosion is prevented by applying an anticorrosion treatment to a wire connecting portion with a resin mold or the like. However, since this anticorrosion treatment method is for covering the entire wire connecting portion, the wire connecting portion becomes one size larger. Thus, a housing is provided with an escaping structure in some cases in order to avoid the interference of the anticorrosive with the housing in which this terminal is accommodated.

Generally, plating is applied to a surface of a copper base material constituting a terminal. However, in a terminal production process, the copper base material having the surface covered with the plating is punched, whereby copper is exposed on end parts of the base material. Thus, electrolytic corrosion more easily occurs on the end parts of the base material where copper is exposed than on parts having the surface covered with the plating. Specifically, in the case of taking an anticorrosion measure for an aluminum wire with priority given to easy occurrence of electrolytic corrosion, it is first essential to seal the end parts of the base material where copper is exposed with an anticorrosive.

The present invention was completed based on the above situation and aims to realize the miniaturization of a wire with corrosion-resistant terminal by making a range covered with an anticorrosive smaller.

SUMMARY

The present invention is directed to a wire with corrosion-resistant terminal, including a coated wire in which a core is covered with a coating, and a corrosion-resistant terminal which is formed by applying bending to a piece punched out from a base material made of a different type of metal from the core and includes a wire connecting portion connected to an end of the coated wire and in which the metal exposed on an end part of the base material constituting the wire connecting portion is covered with an anticorrosive, wherein a pair of end parts of the base material in the wire connecting portion are provided to face inward on an upper surface of the wire connecting portion while winding around the ends of the coated wire, a storage portion is formed by being surrounded by the pair of end parts of the base material, and the anticorrosive is stored in the storage portion and arranged in a region narrower than a maximum width region on the upper surface of the wire connecting portion.

According to such a configuration, since the anticorrosive is arranged in the region narrower than the maximum width region on the upper surface of the wire connecting portion, the corrosion-resistant terminal after sealing with the anticorrosive is not enlarged beyond the maximum width of the upper surface of the wire connecting portion. Further, since the metal exposed on the end parts of the base material is sealed with the anticorrosive by storing the anticorrosive in the storage portion, the occurrence of electrolytic corrosion between the exposed metal and the core of the coated wire can be prevented. The miniaturization of the coated wire with corrosion-resistant terminal can be realized by making a range covered with the anticorrosive smaller while preventing electrolytic corrosion in the wire connecting portion.

The wire connecting portion may include a wire barrel to be crimped to the core and an insulation barrel to be crimped to the coating, and the storage portion may include a front storage portion formed to include a front end part of the wire barrel and a rear storage portion formed to include a rear end part of the wire barrel.

The wire barrel is crimped by swaging and rolling a pair of barrel pieces constituting the wire barrel inwardly. According to the above configuration, the storage portions are provided on both front and rear sides of the wire barrel, wherefore the storage portions are easily formed.

A bell-mouth inclined upwardly toward a back side may be formed on a rear end part of the wire barrel and the rear storage portion may extend backward from the end part of the base material exposed on a rear end of the bell-mouth.

According to such a configuration, the rear storage portion can be formed using the bell-mouth formed on the rear end of the wire barrel.

The coated wire may be a wire including a core made of aluminum or aluminum alloy, whereas the corrosion-resistant terminal may be formed of the base material made of copper or copper alloy.

According to such a configuration, electrolytic corrosion likely to occur between the coated wire and the base material made of copper or copper alloy can be prevented.

According to the present invention, it is possible to realize the miniaturization of an entire terminal by making a range covered with an anticorrosive smaller.

DETAILED DESCRIPTION

Figure 1:
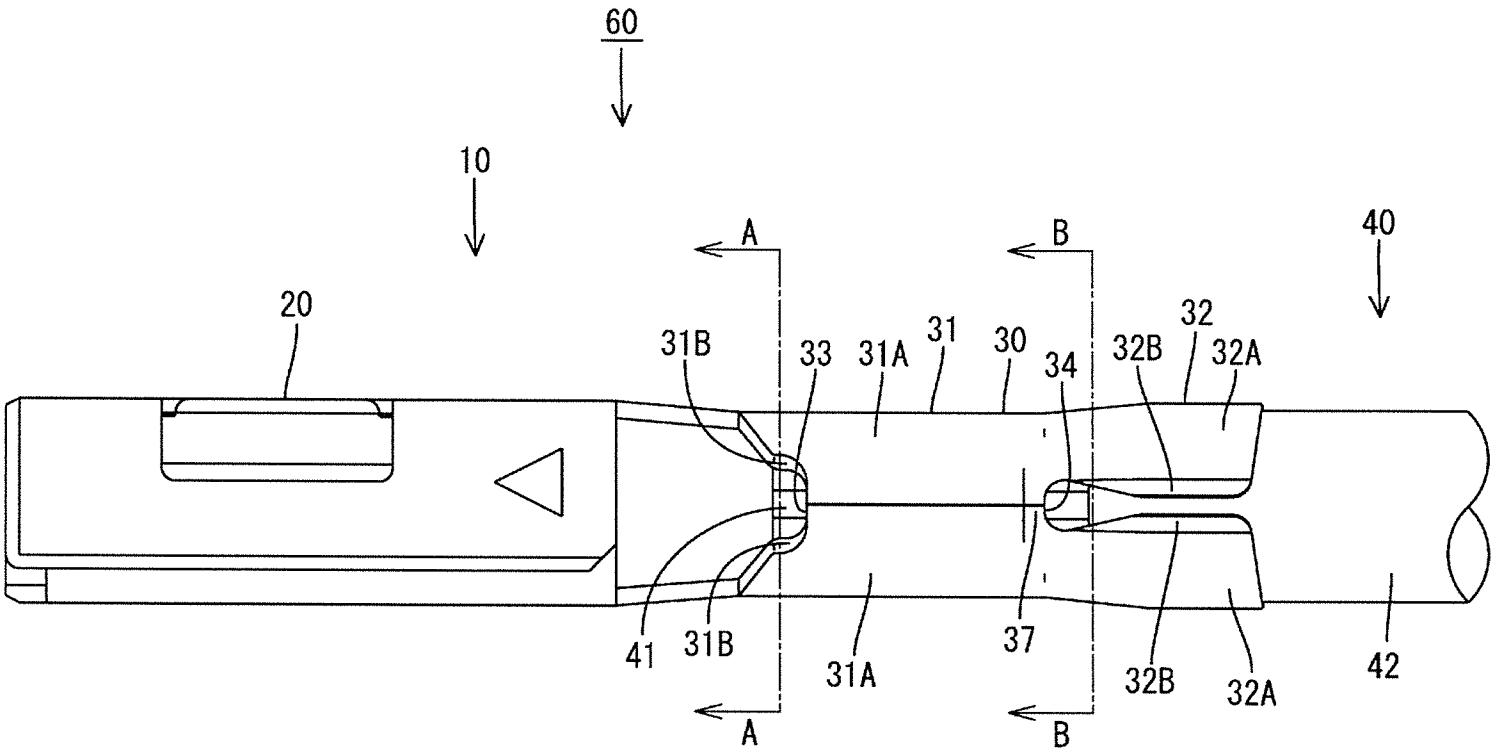
FIG. 1 is a plan view of an aluminum wire with corrosion-resistant terminal.

An embodiment of the present invention is described with reference to FIGS. 1 to 15. A corrosion-resistant terminal 10 in this embodiment includes a terminal connecting portion 20 in the form of a rectangular tube and a wire connecting portion 30 formed behind this terminal connecting portion 20 as shown in FIG. 8. The wire connecting portion 30 is crimped to an end of an aluminum wire 40 as shown in FIG. 1 and an anticorrosive 50 is applied to the wire connecting portion 30 as shown in FIG. 4, whereby an aluminum wire with corrosion-resistant terminal 60 is configured. The anticorrosive 50 is cured by UV irradiation for a predetermined time after being dripped or sprayed in a state of liquid concentrate from above the corrosion-resistant terminal 10.

The corrosion-resistant terminal 10 is formed by punching out a base material made of copper alloy and applying bending and the like to a punched-out piece. As shown in FIG. 8, the terminal connecting portion 20 is formed into a box shape in the form of a rectangular tube and a resilient contact piece 21 is formed in this terminal connecting portion 20. This resilient contact piece 21 extends backward from the front edge of a bottom wall of the terminal connecting portion 20 and is resiliently deformable. When a tab-like male terminal (not shown) is connected to the corrosion-resistant terminal 10, the male terminal is sandwiched between the resilient contact piece 21 and a ceiling wall of the terminal connecting portion 20, whereby the male terminal and the corrosion-resistant terminal 10 are electrically conductively connected.

The wire connecting portion 30 includes a wire barrel 31 to be connected to a core 41 of the aluminum wire 40 and an insulation barrel 32 to be connected to a coating 42 of the aluminum wire 40. Further, the wire connecting portion 30 includes a bottom wall 38 common to the terminal connecting portion 20. The core 41 is formed by twisting a plurality of metal strands made of aluminum. Further, the coating 42 is made of insulating resin. The core 41 is exposed by removing the coating 42 at an end of the aluminum wire 40, the wire barrel 31 is crimped and electrically conductively connected to this core 41 and the insulation barrel 32 is crimped to the coating 42.

The wire barrel 31 includes a pair of wire barrel pieces 31A standing up from opposite side edges of the bottom wall 38 common to the terminal connecting portion 20 and is crimped to the core 41 in such a manner as to bite into the core 41 while rolling these wire barrel pieces 31A inwardly. On the other hand, the insulation barrel 32 includes a pair of insulation barrel pieces 32A standing up from the opposite side edges of the bottom wall 38 common to the terminal connecting portion 20 and is crimped to the coating 42 in such a manner as to extend along the outer peripheral surface of the coating 42 by these insulation barrel pieces 32A. As shown in FIG. 1, the tips of the insulation barrel pieces 32A after crimping are arranged with a predetermined gap formed therebetween without overlapping each other.

Figure 14:
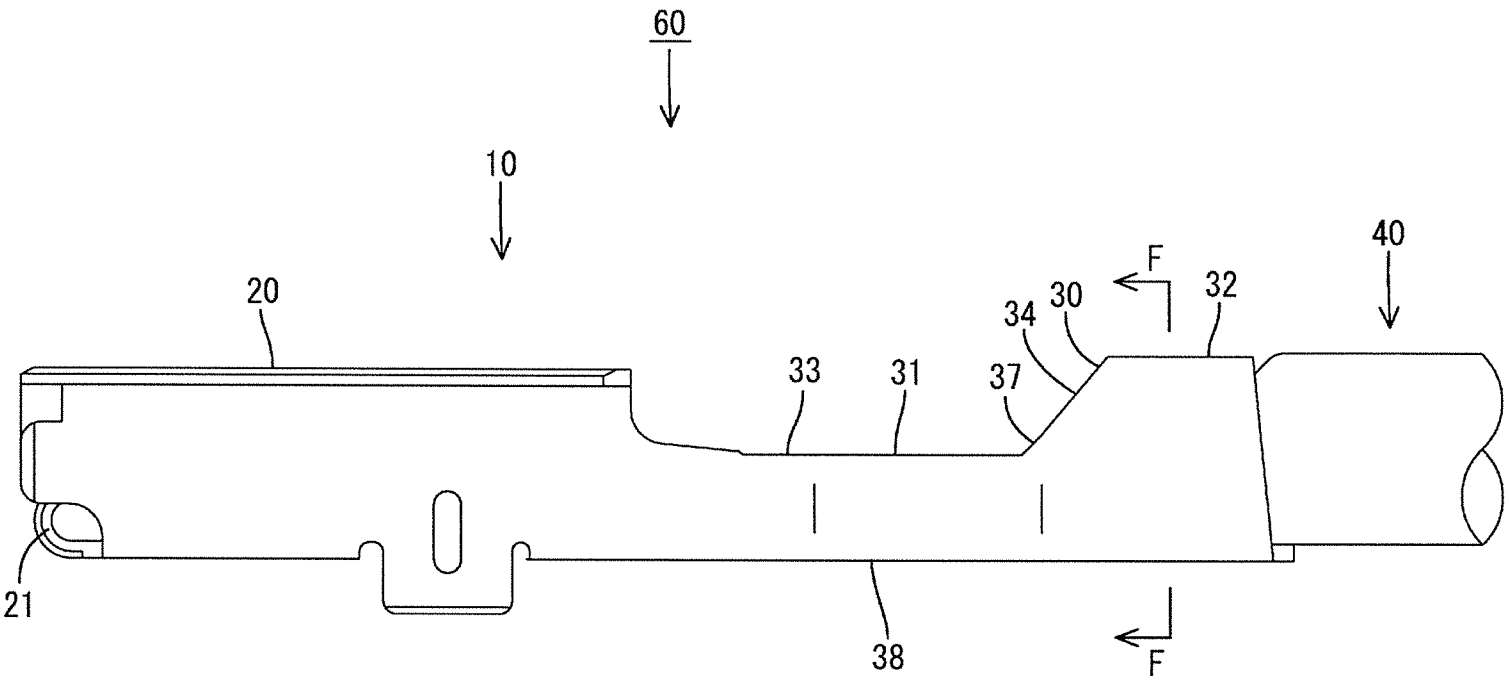
FIG. 14 is a side view of the aluminum wire with corrosion-resistant terminal.

A pair of storage portions 33, 34 are formed on both front and rear sides of the wire barrel 31. Out of these, the storage portion located on the front side is referred to as a front storage portion 33 and the storage portion located on the rear side is referred to as a rear storage portion 34. As shown in FIG. 14, a front end part of the wire barrel 31 is formed with no bell-mouth, a rear end part of the wire barrel 31 is formed with a bell-mouth 37 at the time of crimping, and this bell-mouth 37 has a tapered shape inclined upward toward the back as it extends from the rear end part of the wire barrel 31. Further, the wire barrel 31 and the insulation barrel 32 are seamlessly and continuously formed in a side view and the rear storage portion 34 is formed in this continuous part. Note that, as shown in FIG. 1, the rear storage portion 34 extends directly backward from an end part of the base material exposed on the rear end of the bell-mouth 37.

Figure 2:
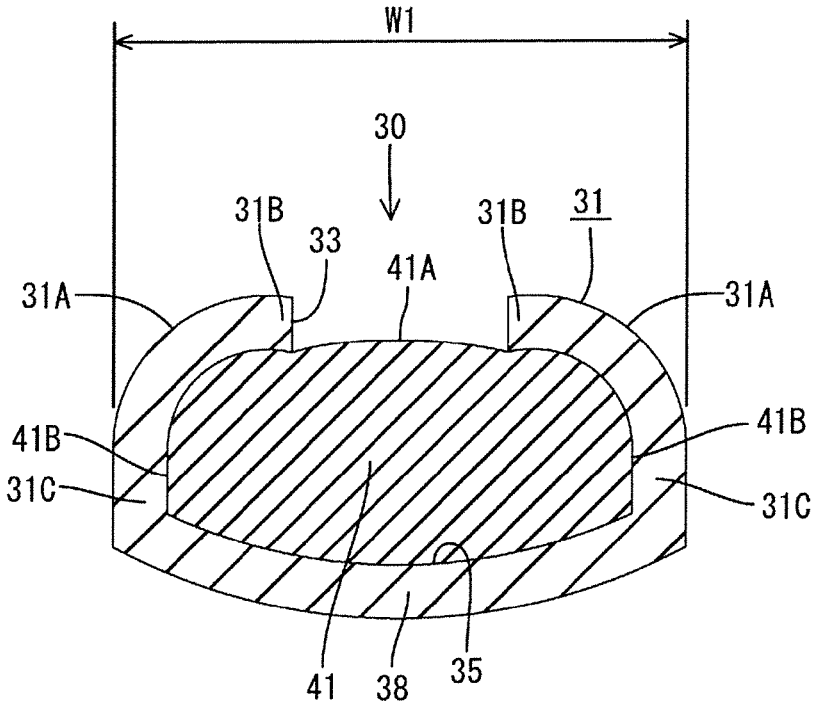
FIG. 2 is a section along A-A of FIG. 1.

As shown in FIG. 2, the front storage portion 33 is in the form of a recess open upward and surrounded by tip parts 31B of the pair of left and right wire barrel pieces 31A and an upper part 41A of the core 41. The respective wire barrel pieces 31A are arranged to be wound around the core 41, the tip parts 31B of the respective wire barrel piece 31A are both arranged to face inward on the upper part 41A of the core 41 and base end parts 31C thereof are both arranged to vertically extend on opposite side parts 41B of the core 41. Further, the tip parts 31B of the respective wire barrel pieces 31A are facing each other in a lateral direction and both arranged substantially perpendicular to the upper part 41A of the core 41.

Figure 5:
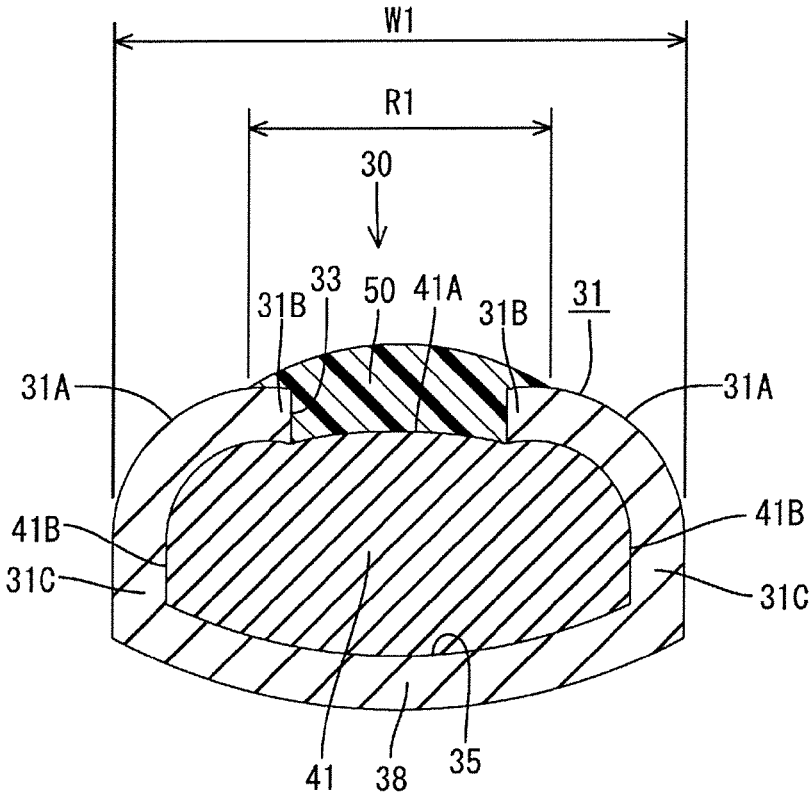
FIG. 5 is a section along C-C of FIG. 4.

Thus, if the anticorrosive 50 is dripped into the front storage portion 33, most of the anticorrosive 50 is stored in the front storage portion 33 and the anticorrosive 50 leaking out from this front storage portion 33 is also stored between the tip parts 31B as shown in FIG. 5, wherefore the anticorrosive 50 does not flow out to the base end parts 31C. Specifically, since the anticorrosive 50 applied to the wire barrel 31 is arranged in a region R1 narrower than a maximum width region W1 on the upper surface of the wire barrel 31, the wire barrel 31 is not enlarged by the anticorrosive 50.

Figure 3:
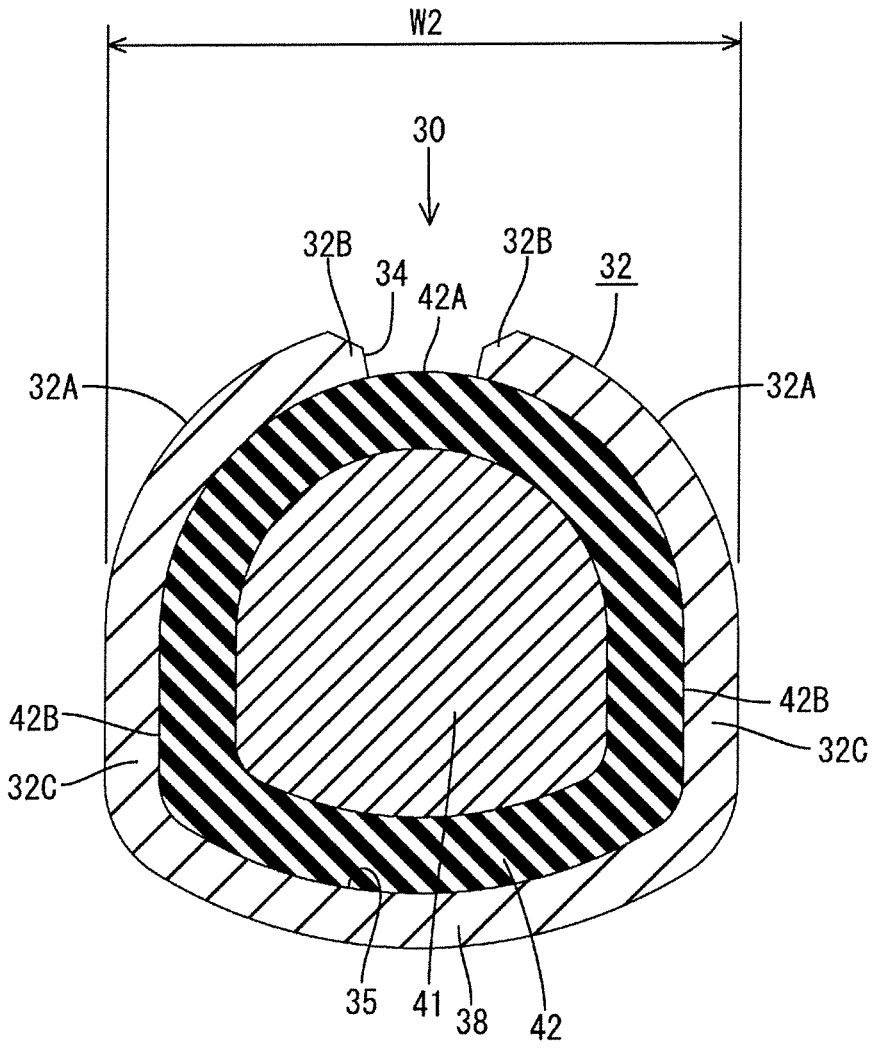
FIG. 3 is a section along B-B of FIG. 1.
Figure 4:
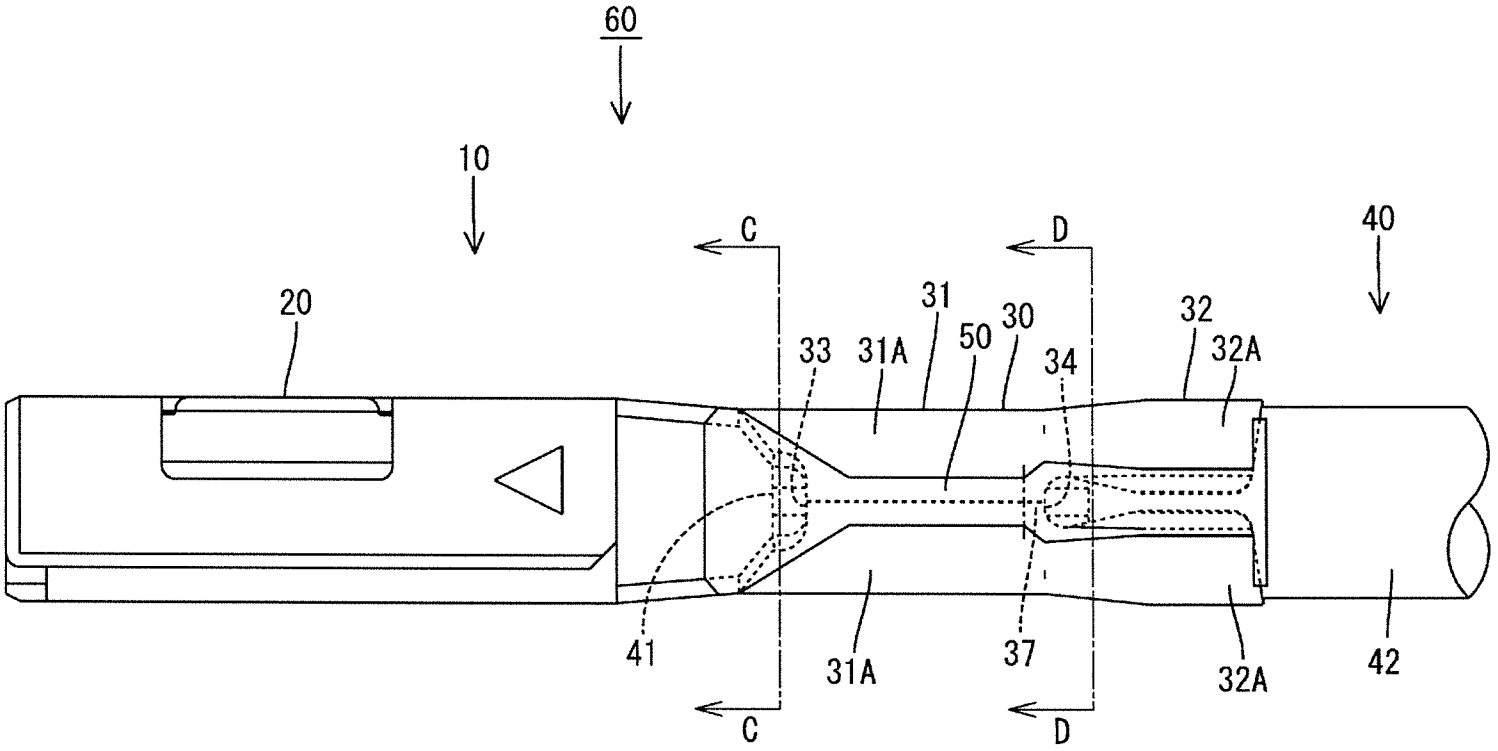
FIG. 4 is a plan view showing a state where an anticorrosion treatment is applied to the aluminum wire with corrosion-resistant terminal.

As shown in FIG. 3, the rear storage portion 34 is in the form of a recess open upward and surrounded by tip parts 32B of the pair of left and right insulation barrel pieces 32A and an upper part 42A of the coating 42. The respective insulation barrel pieces 32A are arranged to be wound around the coating 42, the tip parts 32B of the respective insulation barrel piece 32A are both arranged to face inward on the upper part 42A of the coating 42 and base end parts 32C thereof are both arranged to vertically extend on opposite side parts 42B of the coating 42. Further, the tip parts 32B of the respective insulation barrel pieces 32A are facing each other in the lateral direction and both arranged substantially perpendicular to the upper part 42A of the coating 42.

Figure 6:
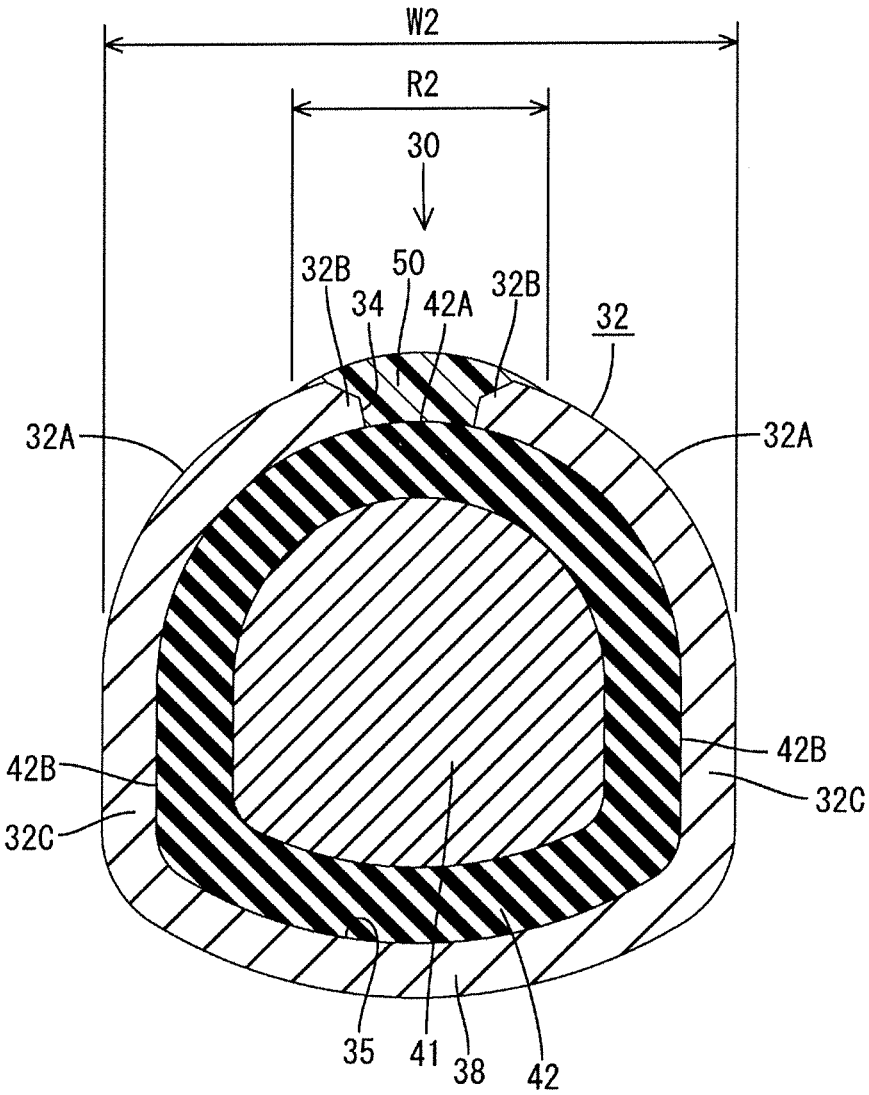
FIG. 6 is a section along D-D of FIG. 4.

Thus, if the anticorrosive 50 is dripped into the rear storage portion 34, most of the anticorrosive 50 is stored in the rear storage portion 34 and the anticorrosive 50 leaking out from this rear storage portion 34 is also stored between the tip parts 32B as shown in FIG. 6, wherefore the anticorrosive 50 does not flow out to the base end parts 32C. Specifically, since the anticorrosive 50 applied to the insulation barrel 32 is arranged in a region R2 narrower than a maximum width region W2 on the upper surface of the insulation barrel 32, the insulation barrel 32 is not enlarged by the anticorrosive 50.

Figure 7:
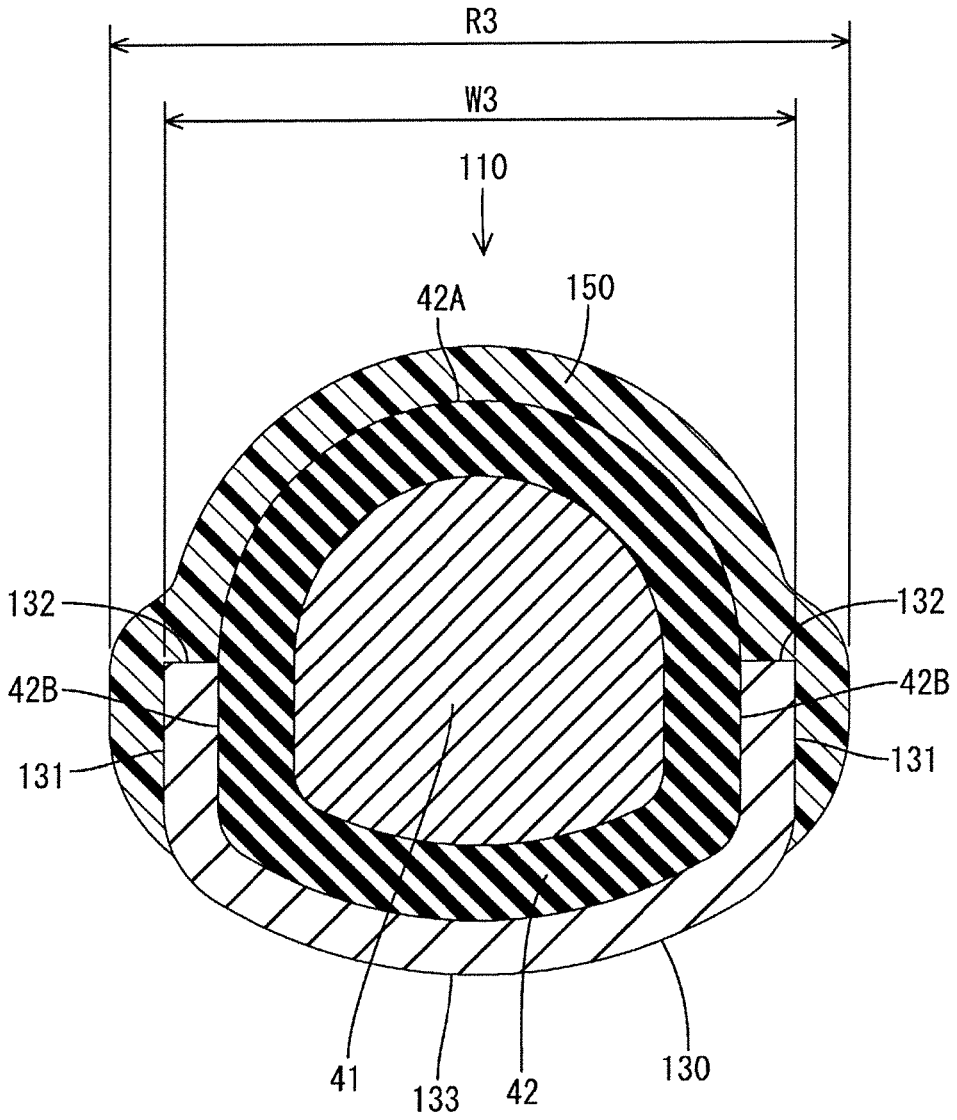
FIG. 7 is a section, corresponding to FIG. 6, of a conventional aluminum wire with corrosion-resistant terminal.
Figure 8:
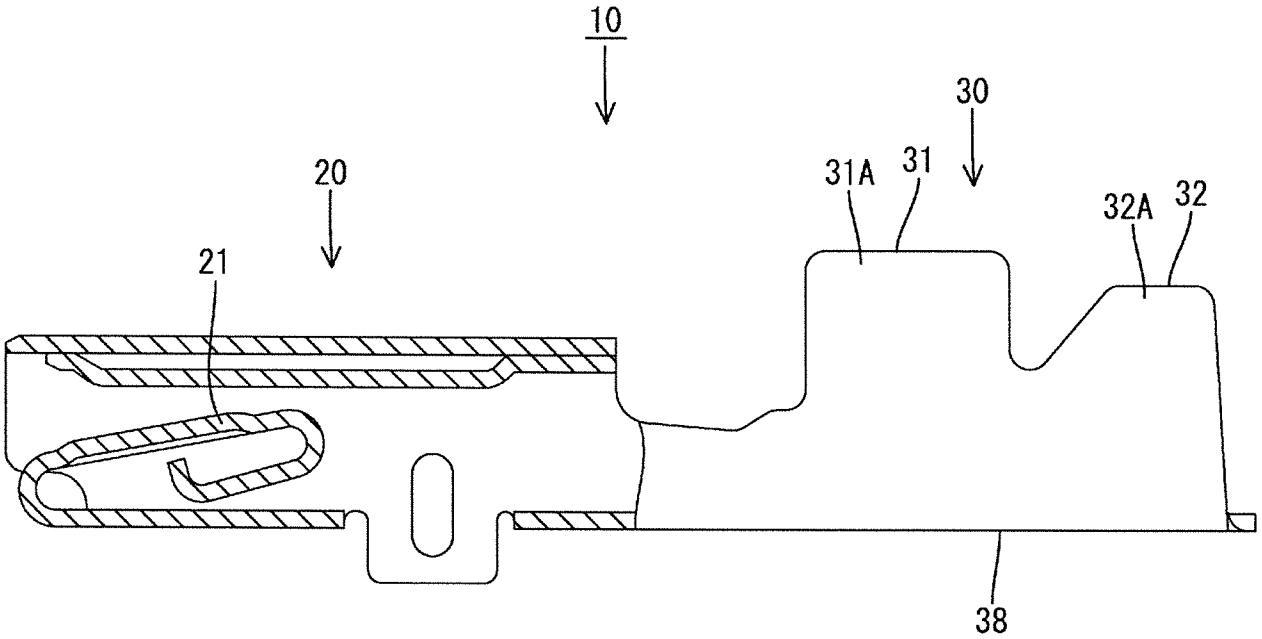
FIG. 8 is a side view partly in section of a corrosion-resistant terminal.

Here, effects of the corrosion-resistant terminal 10 of this embodiment are described in comparison to a conventional corrosion-resistant terminal 110 shown in FIG. 7. In the conventional corrosion-resistant terminal 110, a wire connecting portion 130 is provided with no storage portion for storing an anticorrosive 150. Specifically, tip parts 132 of barrel pieces 131 are arranged to face upward on opposite side parts 42B of a coating 42. Thus, the anticorrosive 150 dripped onto an upper part 42A of the coating 42 flows down along the upper part 42A of the coating 42 and reaches a bottom surface 133 beyond the tip parts 132 of the barrel pieces 131 arranged on the opposite side parts 42B of the coating 42. This causes the anticorrosive 150 to be applied in a region R3 wider than a maximum width region W3 on the upper surface of the wire connecting portion 130 and the wire connecting portion 130 is enlarged one size larger by the anticorrosive 150. Contrary to this, in the corrosion-resistant terminal 10 of this embodiment, the wire connecting portion 30 is not covered with the anticorrosive 50 over the entire circumference as shown in FIG. 6 (insulation barrel 32 is illustrated in FIG. 6) and the wire connecting portion 30 can be miniaturized in the lateral direction by an area where the anticorrosive 50 is absent.

Figure 9:
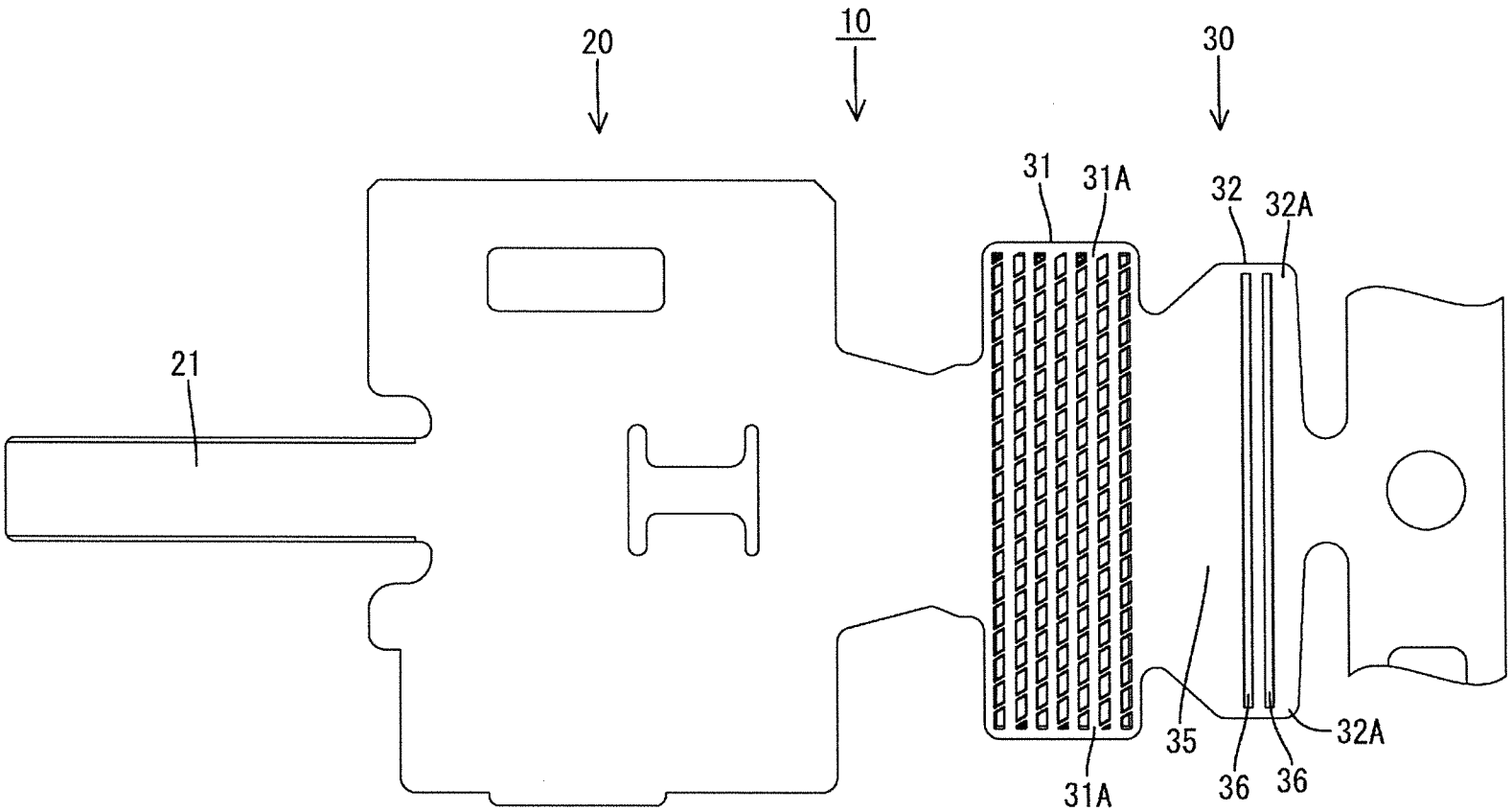
FIG. 9 is a development of the corrosion-resistant terminal.
Figure 11:
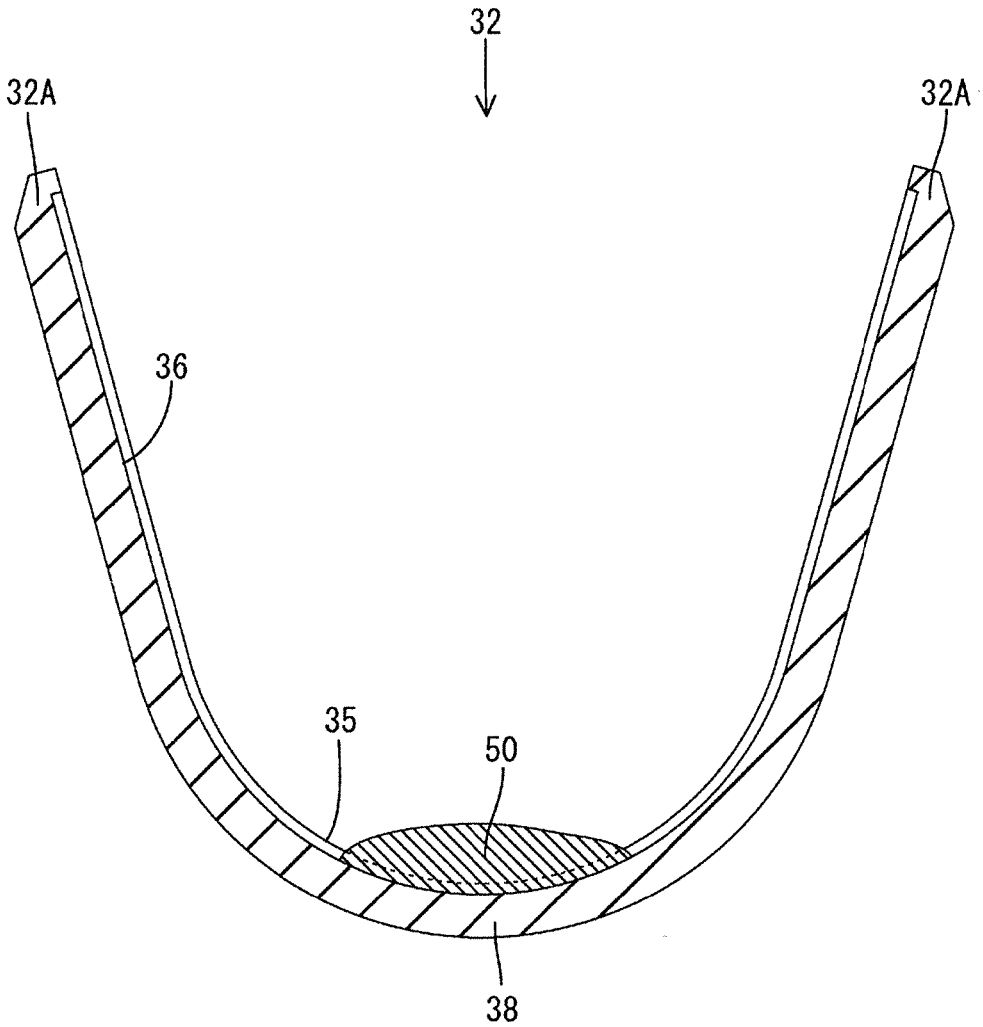
FIG. 11 is a section along E-E of FIG. 10.
Figure 12:
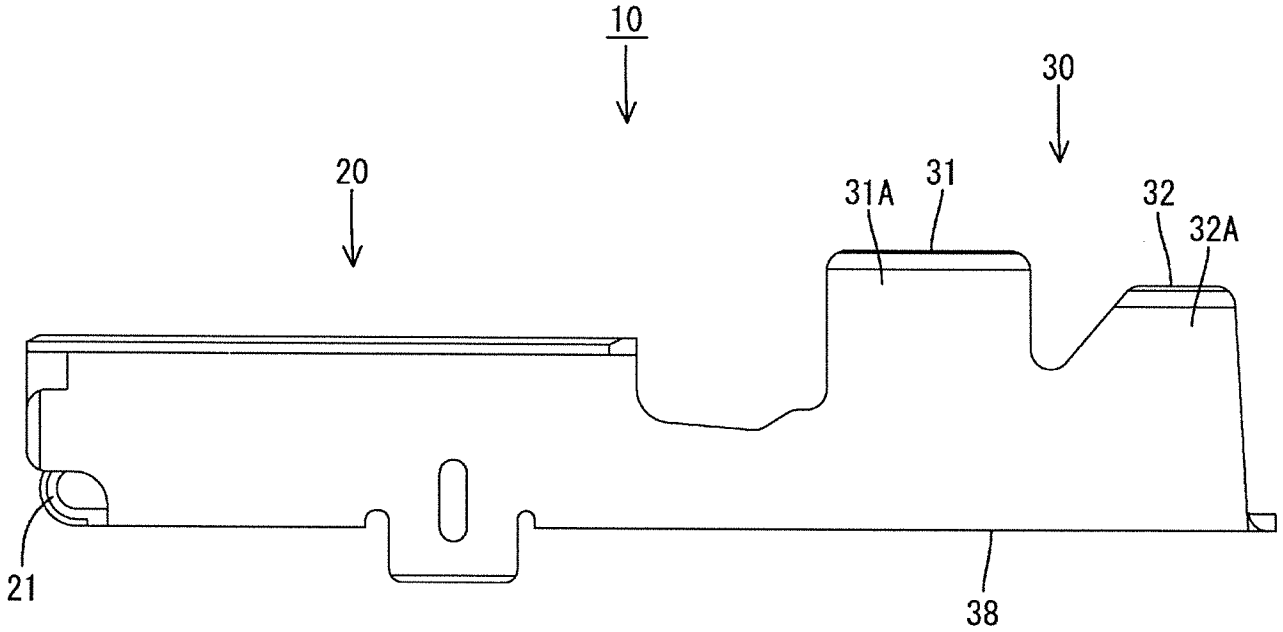
FIG. 12 is a side view of the corrosion-resistant terminal shown in FIG. 10.

Next, a serration structure of the insulation barrel 32 is described. As shown in FIG. 9, a plurality of anticorrosive penetration grooves 36 are formed on a crimping surface (forward facing surface shown in FIG. 9) of the insulation barrel 32. The anticorrosive penetration grooves 36 in a development state are formed to extend straight perpendicular to an axial direction of the aluminum wire 40. Thereafter, the insulation barrel 32 is formed into a substantially U shape by being bent and, associated with this, the anticorrosive penetration grooves 36 are also formed into a substantially U shape. As shown in FIG. 11, opposite end parts of the anticorrosive penetration groove 36 are closed without being open on the tip parts of the insulation barrel pieces 32A.

Figure 10:
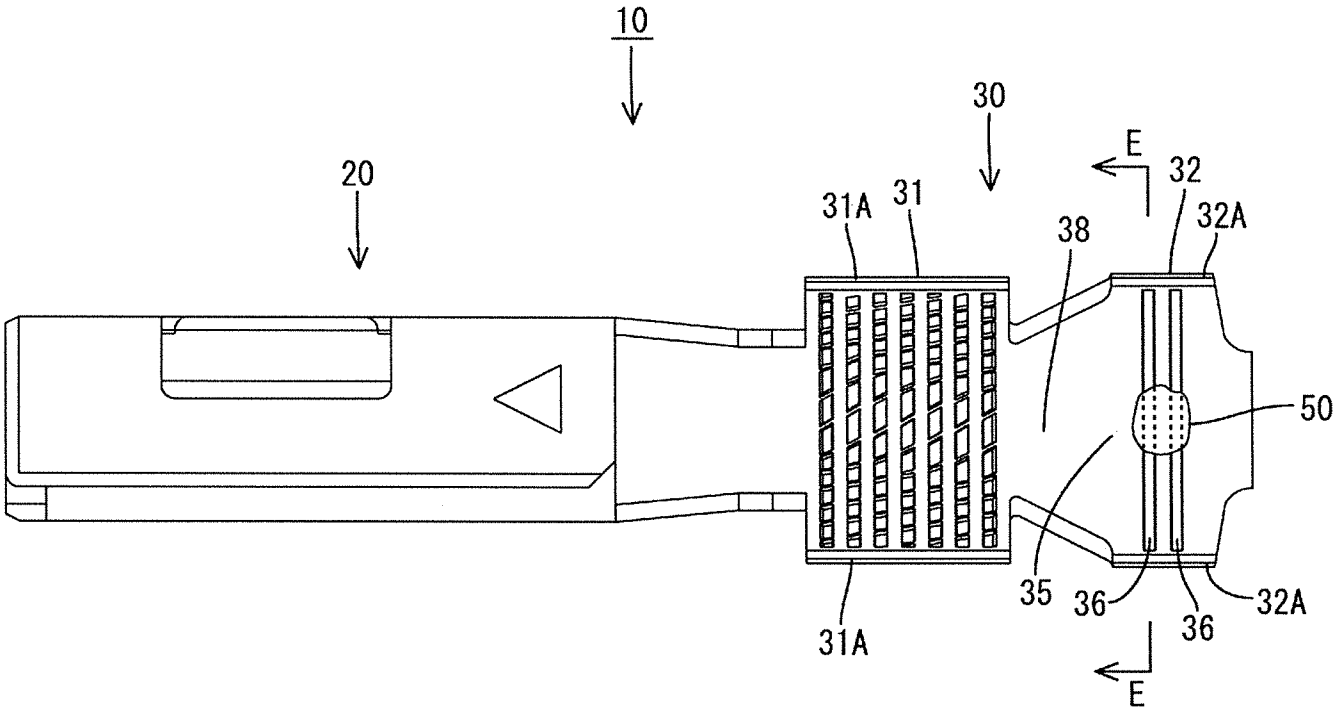
FIG. 10 is a plan view showing a state where an anticorrosive is dripped into anticorrosive penetration grooves on the bottom surface of an insulation barrel.
Figure 13:
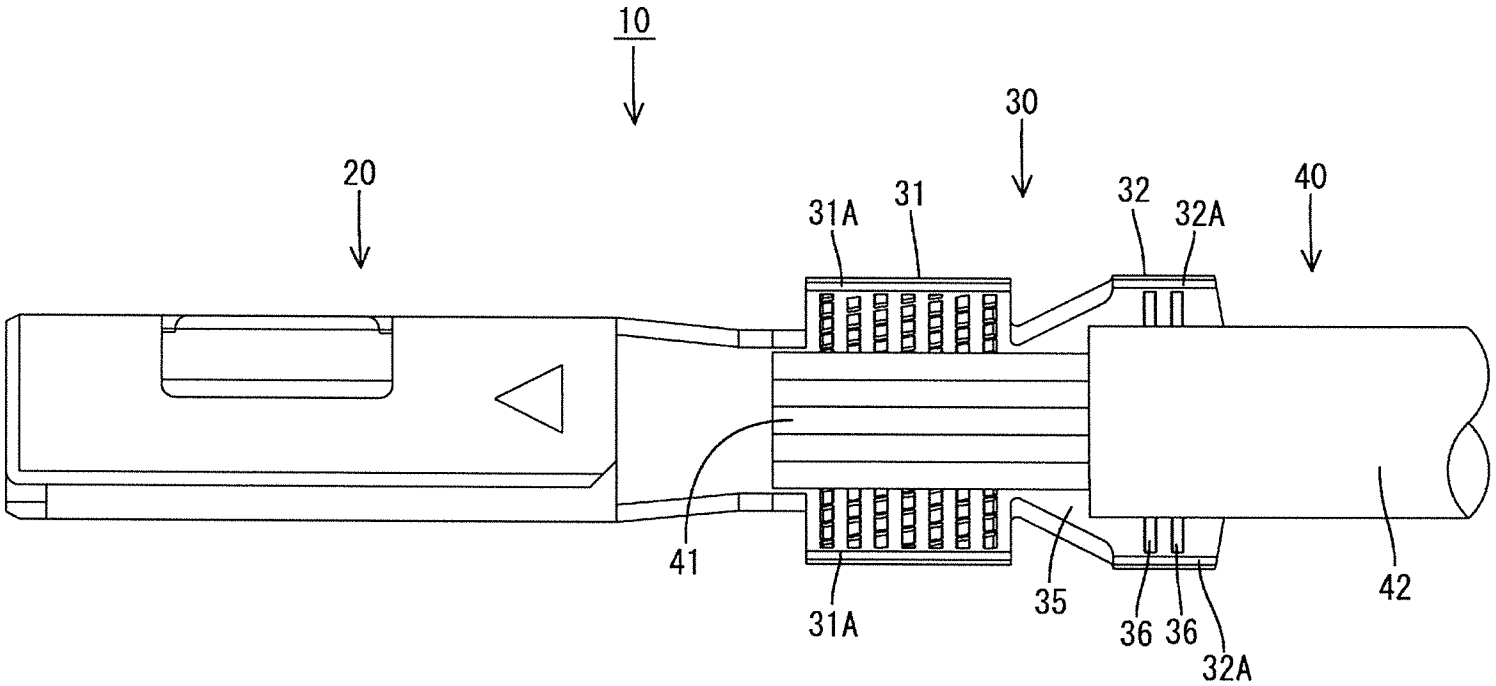
FIG. 13 is a plan view showing a state where an end of an aluminum wire is placed on a wire connecting portion of the corrosion-resistant terminal.
Figure 15:
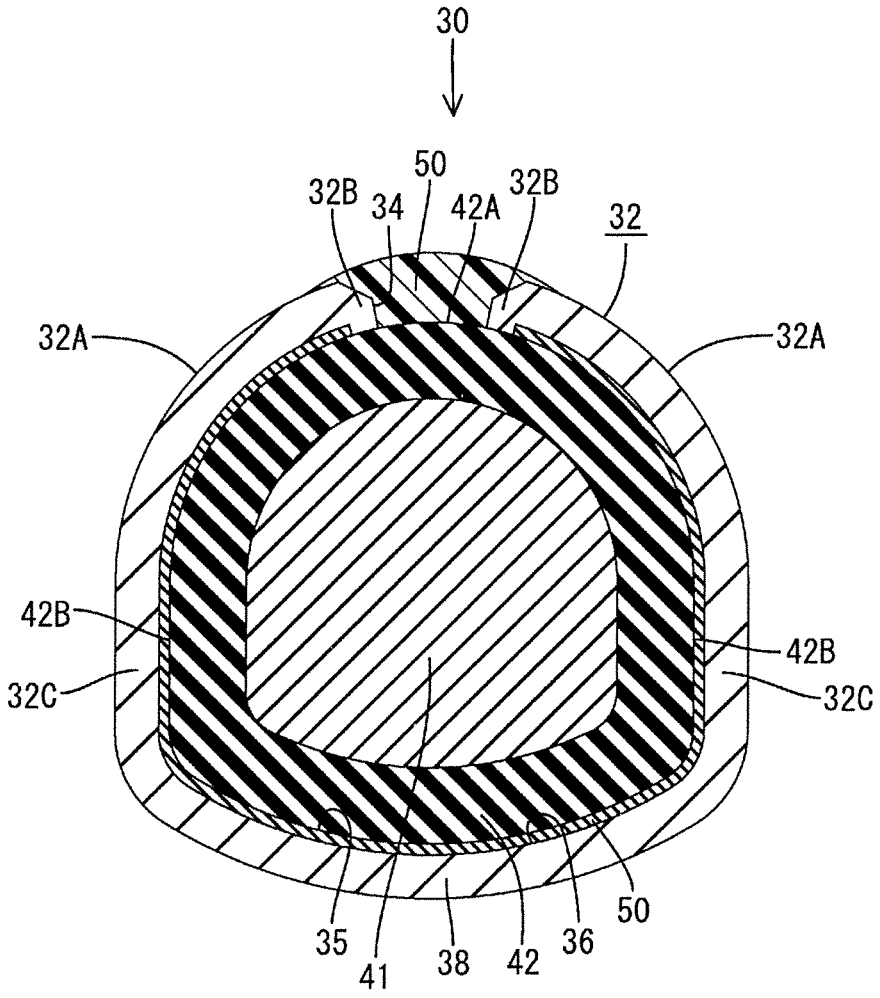
FIG. 15 is a section along F-F of FIG. 14 cut at the same position as in FIG. 11.

As shown in FIG. 10, the anticorrosive 50 is applied to the crimping surface 35 of the insulation barrel 32 in advance. This anticorrosive 50 is applied in a region of the crimping surface 35 including each anticorrosive penetration groove 36. Subsequently, when the coating 42 is placed on the crimping surface 35 of the insulation barrel 32 as shown in FIG. 13 and crimping is performed, the anticorrosive 50 pressed by the coating 42 moves along the anticorrosive penetration grooves 36 to spread in a circumferential direction. After crimping, the anticorrosive 50 is filled in the anticorrosive penetration grooves 36 as shown in FIG. 15. Thus, the anticorrosive 50 can be reliably present between the crimping surface 35 of the insulation barrel 32 and the coating 42 and the penetration of water to an interface of the core 41 and the wire barrel 31 through an interface of the crimping surface 35 of the insulation barrel 32 and the coating 42 from behind the insulation barrel 32 can be prevented, with the result that electrolytic corrosion can be prevented.

Next, functions of this embodiment configured as described above are described. To produce the aluminum wire with corrosion-resistant terminal 60, the anticorrosive 50 is first dripped onto the crimping surface 35 of the insulation barrel 32 to be partially applied as shown in FIG. 10 and UV irradiation is performed if necessary (pre-crimping applying step). As a result, the anticorrosive 50 is stored in the storage portions 33, 34 as shown in FIGS. 5 and 6 and arranged in the regions R1, R2 narrower than the maximum width regions W1, W2 on the upper surface of the wire connecting portion 30.

Subsequently, as shown in FIG. 13, the end of the aluminum wire 40 is placed on the wire connecting portion 30. At this time, the core 41 is arranged on the wire barrel 31 and the coating 42 is arranged on the insulation barrel 32. When the wire connecting portion 30 is crimped, the wire barrel 31 is crimped to the core 41 and the core 41 bites into knurling serration formed on a crimping surface of the wire barrel 31, whereby an oxide film on the surface of the core 41 is destroyed to establish an electrical conduction. Simultaneously with this, the insulation barrel 32 is crimped to the coating 42 and the anticorrosive 50 is filled into the anticorrosive penetration grooves 36 and applied to the entire crimping surface 35 (crimping step). Since this crimping is performed by a C-crimping method (such a crimping method that the tips of the respective insulation barrel pieces 32A do not overlap and a C-shaped cross-section is obtained), the respective insulation barrel pieces 32A and the coating 42 are held in close contact without any clearance. Further, since the anticorrosive 50 is present between the crimping surface 35 of the insulation barrel 32 and the coating 42, there is no possibility that water penetrates to the side of the core 41 along the surface of the coating 42 of the aluminum wire 40.

After crimping, the front and rear storage portions 33, 34 are formed as shown in FIG. 1. Subsequently, a necessary amount of the anticorrosive 50 is dripped and applied to the front and rear storage portions 33, 34 and UV irradiation is performed (post-crimping applying step). Then, as shown in FIG. 4, the anticorrosive 50 is cured while being retained on the upper surface of the wire connecting portion 30, wherefore the wire connecting portion 30 needs not become larger than the maximum width regions W1, W2 of the respective barrels 31, 32. Since each storage portion 33, 34 is formed by being surrounded by copper alloy exposed by punching out the base material obtained by applying tin plating to the surface of the raw material made of copper alloy, the anticorrosive 50 dripped into each storage portion 33, 34 inevitably comes into contact with the exposed copper alloy and exposure surfaces of the exposed copper alloy can be efficiently sealed with the anticorrosive 50. In other words, since the end parts of the copper alloy are concentrated on one position, the entire wire connecting portion 30 needs not be covered with the anticorrosive 50 and the application of the anticorrosive 50 can be suppressed to a minimum level.

As described above, in this embodiment, the anticorrosive 50 is arranged in the regions narrower than the maximum width regions W1, W2 on the upper surface of the wire connecting portion 30. Thus, the corrosion-resistant terminal 10 after sealing with the anticorrosive 50 is not enlarged beyond the maximum width of the upper surface of the wire connecting portion 30. Further, since copper alloy exposed on the end parts of the base material are sealed with the anticorrosive 50 by storing the anticorrosive 50 in the storage portions 33, 34, the occurrence of electrolytic corrosion between the exposed copper alloy and the core 41 of the aluminum wire 40 can be prevented. The miniaturization of the aluminum wire with corrosion-resistant terminal 60 can be realized by making a range covered with the anticorrosive 50 smaller while preventing electrolytic corrosion in the wire connecting portion 30.

The wire connecting portion 30 may include the wire barrel 31 to be crimped to the core 41 and the insulation barrel 32 to be crimped to the coating 42 and the storage portions may include the front storage portion 33 formed to include the front end part of the wire barrel 31 and the rear storage portion 34 formed to include the rear end part of the wire barrel 31. The wire barrel 31 is crimped by swaging and rolling the pair of wire barrel pieces 31A constituting the wire barrel 31 inwardly. According to the above configuration, the storage portions 33, 34 are provided on both front and rear sides of the wire barrel 31, wherefore the storage portions 33, 34 are easily formed.

The bell-mouth 37 inclined upwardly toward the back may be formed on the rear end part of the wire barrel 31 and the rear storage portion 34 may extend backward from the end part of the base material exposed on the rear end of the bell-mouth 37. According to such a configuration, the rear storage portion 34 can be formed using the bell-mouth 37 formed on the rear end of the wire barrel 31.

The coated wire may be the aluminum wire 40 including the core 41 made of aluminum or aluminum alloy, whereas the corrosion-resistant terminal 10 may be formed of the base material made of copper or copper alloy. According to such a configuration, electrolytic corrosion likely to occur between the aluminum wire 40 and the base material made of copper or copper alloy can be prevented.

The present invention is not limited to the above described and illustrated embodiment. For example, the following embodiments are also included in the technical scope of the present invention.

Although the female terminal including the terminal connecting portion 20 is illustrated as the corrosion-resistant terminal 10 in the above embodiment, the present invention may be applied to a male terminal including a tab-like connecting portion.

Although the UV curable anticorrosive 50 is used in the above embodiment, a thermosetting or thermoplastic anticorrosive may be used.

Although the anticorrosive 50 is continuously applied from the front storage portion 33 to the rear storage portion 34 in the above embodiment, the anticorrosive 50 may be applied in spots to the front and rear storage portions 33, 34 according to the present invention.

Although the coated wire including the core made of a plurality of metal strands is illustrated in the above embodiment, it may include, for example, a core formed of one metal strand having a relatively large diameter, i.e. a single-core coated wire.

Although the corrosion-resistant terminal 10 made of copper alloy is connected to the aluminum wire 40 in the above embodiment, other materials may be used provided that a core of a coated wire and a corrosion-resistant terminal to be connected to this core are formed of different types of metals. For example, copper with excellent strength may be used as a constituent material of the corrosion-resistant terminal.

LIST OF REFERENCE SIGNS

10 . . . corrosion-resistant terminal
30 . . . wire connecting portion
31 . . . wire barrel
32 . . . insulation barrel
33 . . . front storage portion
34 . . . rear storage portion
37 . . . bell-mouth
40 . . . aluminum wire (coated wire)
41 . . . core
42 . . . coating
50 . . . anticorrosive
60 . . . aluminum wire with corrosion-resistant terminal
R1 . . . region of front storage portion
R2 . . . region of rear storage portion
W1 . . . maximum width region of wire barrel
W2 . . . maximum width region of insulation barrel

The invention claimed is:

1. A wire with corrosion-resistant terminal, comprising:

a coated wire having a core covered with an insulation coating; and a corrosion-resistant terminal formed by applying bending to a piece punched out from a base material made of a metal different from the core and includes a wire connecting portion connected to an end of the coated wire and metal exposed on an end part of the base material of the wire connecting portion being covered with an anticorrosive, wherein two end parts of the base material in the wire connecting portion face inward on an upper surface of the wire connecting portion while winding around the ends of the coated wire, a storage portion being surrounded by the end parts of the base material, and the anticorrosive is stored in the storage portion and arranged in a region narrower than a maximum width region on the upper surface of the wire connecting portion.

2. The wire with corrosion-resistant terminal of claim 1, wherein the wire connecting portion includes a wire barrel to be crimped to the core and an insulation barrel to be crimped to the coating, and the storage portion includes a front storage portion formed to include a front end part of the wire barrel and a rear storage portion formed to include a rear end part of the wire barrel.

3. The wire with corrosion-resistant terminal of claim 2, wherein a bell-mouth inclined upwardly toward a back side is formed on a rear end part of the wire barrel and the rear storage portion extends backward from the end part of the base material exposed on a rear end of the bell-mouth.

4. The wire with corrosion-resistant terminal of claim 3, wherein the coated wire is a wire including a core made of aluminum or aluminum alloy, whereas the corrosion-resistant terminal is formed of the base material made of copper or copper alloy.

5. The wire with corrosion-resistant terminal of claim 1, wherein the coated wire is a wire including a core made of aluminum or aluminum alloy, whereas the corrosion-resistant terminal is formed of the base material made of copper or copper alloy.

* * * * *